United States Patent [19]

Dallaire

[11] Patent Number: 4,824,733

[45] Date of Patent: Apr. 25, 1989

[54] ANTI-OXIDANT BARRIER FOR CARBON BASED MATERIAL

[75] Inventor: Serge Dallaire, Longueuil, Canada

[73] Assignee: Canadian Patents and Development Limited/Société, Ottawa, Canada

[21] Appl. No.: 41,447

[22] Filed: Apr. 23, 1987

[30] Foreign Application Priority Data

Apr. 25, 1986 [CA] Canada ..... 507650

[51] Int. Cl.[4] ..... H05B 7/06

[52] U.S. Cl. ..... 428/551; 428/565; 373/88

[58] Field of Search ..... 428/551, 565; 373/88

[56] References Cited

U.S. PATENT DOCUMENTS

| | | | |
|---|---|---|---|
| 3,348,929 | 10/1967 | Valtschev et al. | 373/88 |
| 3,476,586 | 11/1969 | Valtchev et al. | 373/88 |
| 3,553,010 | 1/1971 | Rubisch | 373/88 |
| 4,383,321 | 5/1983 | Schieber et al. | 373/88 |

FOREIGN PATENT DOCUMENTS

| | | | |
|---|---|---|---|
| 706351 | 3/1965 | Canada . | |
| 986376 | 3/1976 | Canada . | |
| 1009093 | 5/1957 | Fed. Rep. of Germany . | |
| 1026055 | 4/1966 | United Kingdom . | |
| 1386611 | 3/1975 | United Kingdom | 373/88 |

*Primary Examiner*—John F. Terapane
*Assistant Examiner*—Eric Jorgensen
*Attorney, Agent, or Firm*—Fleit, Jacobson, Cohn & Price

[57] ABSTRACT

There is described a coating providing an anti-oxidant barrier for carbon based material against oxidation at high temperature (temperature higher than 500° C.), more particularly for graphite electrodes used in electric arc furnaces. The coating comprises at least a first layer of metallic titanium or titanium alloy which is applied directly on the carbon-based material, e.g. graphite, and a second layer which comprises a mixture of silicon carbide and aluminum alloy, the second layer being applied on the first layer. This coating substantially extends the life of the carbon-based material. There is also disclosed a method of producing this coating by applying the two layers onto a carbon-based material such as graphite.

7 Claims, 1 Drawing Sheet

ANTI-OXIDANT BARRIER FOR CARBON BASED MATERIAL

BACKGROUND OF THE INVENTION (a) Field of the Invention

This invention relates to an antioxidant barrier for carbon-based material and also to a process of making this antioxidant barrier. More particularly, the invention relates to the lateral protection of graphite electrodes of electric arc furnaces by providing antioxidant coatings on said electrodes.

(b) Description of Prior Art

It is known that carbon-based materials, such as graphite possess good mechanical properties at high temperature and are resistant to thermal shock. This is the reason why graphite has been extensively used as the material of the electrode in arc furnaces. However, above 500° C., graphite oxidizes very rapidly unless it is coated with an antioxidant barrier. On the other hand, the lateral loss of graphite electrodes which are used in electrical arc furnace for melting steel is the result of oxidation. The prior art has reported that 50% of the total graphite consumption in electric arc furnace could be attributed to lateral loss.

Obviously, to reduce this highly pronounced oxidation which takes place at high temperature, the graphite must be protected against any hostile medium by means of a coating or the like. It has also been found that any coating intended to protect graphite against oxidation should satisfy certain requirements. For example, the coating selected should prevent or at least inhibit the diffusion of oxygen and carbon. This coating should be also mechanically compatible with graphite at any temperature and resistant to thermal shock.

Numerous attempts to protect arc furnace electrodes by means of a protective coating have failed to succeed. For example, the coatings of German Patent 1,009,093 which are silver based are too expensive to become commmercial. On the other hand, by utilizing the teaching of British Patent No. 1,026,055 and Canadian Patent No. 986,376, graphite is not really protected against attack by oxidation and against thermal shock.

However, Canadian Patent No. 706,351 and U.S. Pat. No. 3,553,010, both disclose a composite coating which presumably protects the graphite electrode against oxidation. The Canadian Patent No. 706,351 relates to a coating which comprises two layers:

(a) 1st layer: a refractory carbide (TiC, CrC, MoC, SiC, ZrC):

(b) 2nd layer: a refractory alloy or compound of an element of groups IVa to VA of the periodic system with nitrogen, beryllium, boron, aluminum, silicon and phosphorus.

According to the process of Canadian Patent No. 706,351, the element, for example a graphite electrode, must be coated with titanium carbide or titanium carbide is formed thereon, after which the second coat is applied. It has been found that the formation of a coat of titanium carbide is detrimental to the application of the second coat, which is the oxidant protection coat, the coat of titanium carbide reacts with aluminum and silicon to form compounds of poor mechanical properties and coating spalls off easily.

U.S. Pat. No. 3,553,010 describes a first layer of silicon with or without sodium, magnesium, calcium, boron, aluminum, titanium, zirconium, manganeses, iron, carbon, nitrogen, phosphorus and oxygen separately or in combination. The second layer called the cover layer comprises aluminum with or without sodium, magnesium, boron, silicon, phosphorus, oxygen, copper, zinc, lead, titanium, ziconium, chromium, manganese, iron, cobalt, and nickel, separately or in combination. This composite coating is not completely satisfactory against corrosion.

Tests have been made with various coatings in order to determine their suitability to provide a good antioxidant barrier for a graphite electrode. For example, coatings of graphite electrodes have been produced from oxides, oxide cermets, borides, carbides, metals silicides or composites thereof, but none of these have appeared satisfactory. For examples coatings based on oxides and those made of oxide cermets have a definite tendency to crack which leads to the coatings being slowly detached from the graphite electrodes. On the other hand coatings derived from carbides and borides do not afford a sufficient protection against oxidation since losses of up to 30% of the electrode have been found. Metal coatings offer a good protection against oxidation for a limited time, however they are too easily detached from the graphite electrode to be seriously considered as an antioxidant barrier for graphite electrodes. Finally, silicides and their composites have low resistance to thermal shocks and crack easily.

It is therefore an object of the present invention to provide a coating for carbon-based materials which constitutes an antioxidant barrier.

It is another object of the present invention to provide a process for producing coatings for carbon-based materials which behave as antioxidant barrier.

It is another object of the present invention to ensure the lateral protection of graphite electrodes (e.g. steel-furnace electrodes) by reducing consumption of carbon by combustion in oxygen (burn-off).

It is another object of the present invention to provide a coat which becomes more adherent to the carbon-based material and eventually leads to a stable mixture which is relatively unaffected by oxidizing conditions.

It is another object of the present invention to provide an antioxidant barrier for graphite electrode, based on the use of metallic titanium or alloys thereof, silicon carbide and aluminum or an alloy thereof.

SUMMARY OF INVENTION

In accordance with the present invention, there is provided a coating providing an antioxidant barrier for carbon-based material. The coating basically comprises a first layer of metallic titanium or titanium alloy applied directly on the carbon-based material and a second layer comprising a mixture of silicon carbide and aluminum or aluminum alloy applied on said first layer.

In accordance with another embodiment of the present invention, these two layers could be applied on a carbon-based materials previously coated with titanium carbide. An optional intercalated layer of aluminum could be deposited between the layer of titanium or titanium alloy and the layer comprising a mixture of silicon carbide and aluminum or aluminum alloy.

In accordance with a preferred embodiment of the invention, depending on the technique used to apply the layers, and the surface roughness of the carbon-based material, the layers forming the coating should not be thinner than 0.5 $\mu$m, for example about 25 $\mu$m.

In accordance with a preferred embodiment of the invention, the layer containing silicon carbide, comprises about 10 to about 50% by weight silicon carbide and about 90 to about 50% by weight aluminum or aluminum alloy (containing at least 90% Al). A most preferred composition comprises about 35% by weight silicon carbide and about 65% by weight aluminum or aluminum alloy.

In accordance with a preferred embodiment of the invention the layer containing silicon carbide comprises silicon carbide whose particle size is as large as possible in order to reduce the degradation of silicon carbide by aluminum that takes place at about 973° K.. The reaction of silicon carbide with aluminum could indeed produce aluminum carbide ($Al_4C_3$) whose mechanical properties are low. This aluminum carbide is easily hydrated by water or water vapour and damages the coating by forming aluminum hydroxides and generating gas ($CH_4$).

In accordance with a preferred embodiment of the invention, the layers of coating materials are applied by different techniques including for example wire or powder sprayed by flame or plasma, direct spraying of the molten alloy, vapor deposition, sputtering, chemideposition, powder sprayed onto a heated substrate, suspension in one or more liquids onto a heated or cold substrate by spraying, brushing, tipping, rolling, or smearing, which are well known to those skilled in the art.

In accordance with a preferred embodiment of the invention, the coating materials are applied by plasma or flame spraying or by direct spraying of the molten alloys.

In accordance with another embodiment of the invention, there is provided a graphite electrode having thereon a coating as defined above.

There is provided, in accordance with another embodiment, a method of preparing a graphite electrode with an antioxidant barrier thereon which comprises providing a graphite electrode, and applying the layers as mentioned above.

In accordance with the preferred embodiment of the invention, the second layer is a mechanical mixture of powders of aluminum or aluminum alloy with silicon carbide. The second layer may also be an agglomerate of aluminum or aluminum alloy powder with silicon carbide powders or a silicon carbide coated with aluminum or aluminum alloy.

According to the invention there is formed a strong bond between the carbon-based material and the composite coating. This coating possesses good mechanical properties that makes handling easy. Although applicant does not wish to be restricted to a theoretical explanation, it is believed that the titanium or titanium alloy layer acts as a carbon retention material producing a diffusion barrier between the carbon-based material and the second layer. Some titanium carbide can be formed when titanium reacts with carbon. As a result of the above reaction a covalent bond can be formed between the carbon-based material and the titanium thereby improving the adhesion of the coating. Because it acts as a carbon retention material, the titanium or titanium alloy layer prevents the formation of the ionic carbide $Al_4C_3$. The second layer containing silicon carbide and aluminum or aluminum alloy forms a cermet coating which firmly adheres to the former layer and which has an excellent resistance against oxidation. This layer acts as an oxygen retention material and could be considered as a diffusion barrier for oxygen.

According to the invention the resulting coating is more electrically conductive than graphite and this is the reason why it could be applied on graphite electrodes used in electric arc furnaces.

The antioxidant barrier for carbon-based materials (such as graphite) according to the invention, which is composed of a diffusion barrier for carbon and a diffusion barrier for oxygen has an excellent resistance against oxidation and a good resistance to thermal shock as will appear in the following examples. BRIEF DESCRIPTION OF DRAWINGS In the drawings which illustrate the invention, FIG. 1 is a view showing a graphite cylinder according to the invention, after oxidation (the ends not being coated);

FIG. 3 is a curve showing the weight losses due to oxidation of an uncoated cylinder and of another cylinder coated according to the invention.

DESCRIPTION OF PREFERRED EMBODIMENTS

EXAMPLE I

Figure 5:
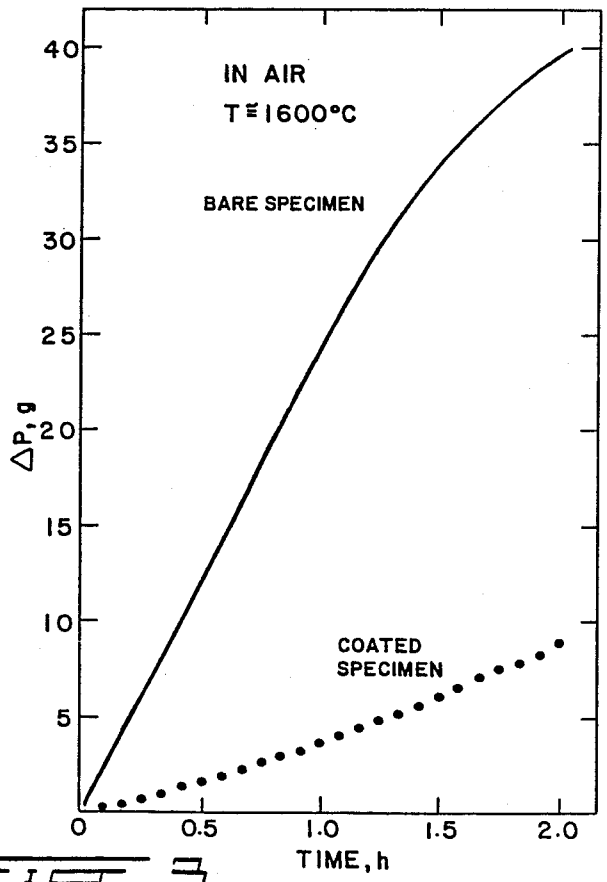
Figure 2:
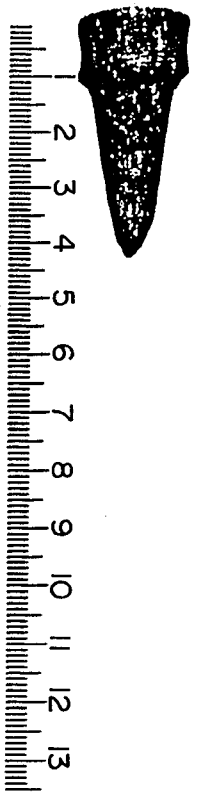
FIG. 2 is a view of another graphite cylinder without coating, after oxidation.
Figure 1:
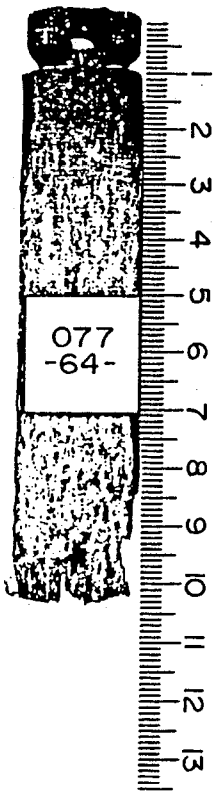

A graphite member which is about the size of a test tube was coated with titanium metal this was followed by another coating comprising a mixture of silicon carbide and aluminum, to produce a coating having a weight ratio of 66% Al and 34% SiC. Both layers were applied by using conventional plasma spraying equipment. The cermet layer was obtained by plasma spraying a mixture of aluminum powders whose particle size is comprised between 50 and 150 μm and silicon carbide powders whose particle size is comprised between 25 and 150 μm. The thickness of the entire coating was 0.0105 inch and its weight was 4.5521 g. The weight of the coated graphite member was 54.5212 g. It was introduced into a furnace maintained at 1600° C. during 2 hours and after that period the total weight was 44.9763 or a loss in percent of 17%. The coated graphite electrode had a good mechanical resistance, a uniform coating and weight consumption of only 17% after two hours. After 24 cycles of coating followed by heating no cracks appeared in the coating FIG. 1 shows the appearance of a graphite cylinder coated as indicated in this example while FIG. 2 shows the same graphite cylinder without coating. FIG. 3 is a curve showing the weight losses due to oxidation of an uncoated graphite cylinder and of another graphite cylinder coated according to the invention.

EXAMPLE II

A graphite member which has a $1\frac{1}{2}$ inch diameter and a length of 24 inches was coated with titanium metal by plasma spraying. The amount of titanium which covered the graphite member corresponds to 0.056 grams per square centimeter which gives a mean thickness of titanium of about 0.005 inch. This was followed by another coating comprising a mixture of silicon carbide and aluminum. This layer was obtained by plasma spraying agglomerates whose particle size is between 32 and 180 μm. These agglomerates were obtained by agglomerating a −325 mesh aluminum powder with a silicon carbide powder whose particle sizes are comprised between about 20 and 50 μm. The agglomerates have a weight ratio 65% Al and 35% SiC. The agglomerates were prepared by using conventional agglomeration techniques. The resulting aluminum silicon carbide coating is dense and adheres well to the former layer. About 0.119 gram of cermet was used to cover each square centimeter. The mean thickess of this layer is about 0.020 inch. The coated graphite member was introduced in a furnace maintained between 1700°–1750° C. and heated during 6 hours. After heating the coating it did not show any sign of failure.

EXAMPLE III

A graphite member as above mentioned was coated by using the same procedure as in example II. However, before applying the two basic layers, titanium carbide was plasma sprayed on the graphite member. About 0.0289 grams of titanium carbide covered each square centimeter of the tested piece. The thickness of the titanium layer measured 0.002 inch while that of aluminum-silicon carbide measured 0.023 inch. This coated member was tested as in example II. After 6½ hours of heating the coating it did not show any sign of failure.

EXAMPLE IV

A graphite electrode measuring 18 inches in diameter and 84 inches long for use in electric arc funaces for melting steel was coated according to this invention. A first titanium layer of a mean thickness of about 0.005 inch was plasma sprayed onto the roughened surface of the graphite member. This was followed by another coating comprising silicon carbide and aluminum as described in examples II and III. This layer has a thickness of about 0.015 inch. The resulting coating had a good adherence and is impervious to oxygen.

After testing at least 5 graphite electrodes in an electric steel furnaces it was found that the electrode consumption had been substantially reduced in comparison with uncoated graphite electrode.

For graphite electrode it appeared that the thickness of the first layer of titanium applied by plasma spraying should be greater than 0.002 inch and lower than 0.010 inch. Thinner coating applied by this technique did not ensure a complete protection against the diffusion of carbon throughout the second layer. The second layer containing aluminum or aluminum alloy and silicon carbide applied by plasma spraying could be about 0.010 inch or greater depending on the protection required.

I claim:

1. A coating providing an antioxidant barrier for carbon-based material, said coating comprising:

a first layer that acts as carbon retention material and consists of metallic titanium or titanium alloy essentially applied directly on said carbon-based material;

a second different layer that acts as a diffusion barrier for oxygen, comprising a mixture of silicon carbide and aluminum or aluminum alloy, said second layer being essentially applied on said first layer.

2. A coating according to claim 1, which has a thickness of at least about 0.5 $\mu$m.

3. A coating according to claim 2, wherein said thickness is about 25 $\mu$m.

4. A coating according to claim 1, wherein said second layer comprises about 10% to about 50% by weight of silicon carbide and about 90% to about 50% by weight aluminum or aluminum alloy.

5. A coating according to claim 4, wherein said second layer comprises about 35% by weight silicon carbide and about 65% by weight aluminum or aluminum alloy.

6. A coating according to claim 1, which comprises a layer of titanium carbide between said carbon-based material and said first and second layers.

7. A coating according to claim 1, which comprises a layer of aluminum intercalated between the layer of metallic titanium or titanium alloy and the layer comprising silicon carbide and aluminum or aluminum alloy.

* * * * *

UNITED STATES PATENT AND TRADEMARK OFFICE

CERTIFICATE OF CORRECTION

PATENT NO. : 4,824,733

DATED : April 25, 1989

INVENTOR(S) : Serge Dallaire

It is certified that error appears in the above-identified patent and that said Letters Patent is hereby corrected as shown below:

On the title page assignee should read

--(73) Assignee: Canadian Patents and Development Limited/Societe canadienne des brevets et d'exploitation limitee--.

Signed and Sealed this

Thirteenth Day of February, 1990

*Attest:*

JEFFREY M. SAMUELS

*Attesting Officer*

*Acting Commissioner of Patents and Trademarks*